US005296800A

United States Patent [19]

Bjorkman et al.

[11] Patent Number: 5,296,800

[45] Date of Patent: Mar. 22, 1994

[54] REGULATED POWER SUPPLY CIRCUIT

[75] Inventors: Ivan N. Bjorkman, Johannesburg; Klaus J. R. Nusse, Randburg, both of South Africa

[73] Assignee: Circuit Breaker Industries Limited, South Africa

[21] Appl. No.: 828,203

[22] Filed: Jan. 30, 1992

[30] Foreign Application Priority Data

Jan. 30, 1991 [ZA] South Africa ..... 91/0683

[51] Int. Cl.[5] ..... G05F 5/00

[52] U.S. Cl. ..... 323/303; 323/311; 323/268; 363/89

[58] Field of Search ..... 323/268, 270, 267, 311, 323/303; 307/296.7; 363/89

[56] References Cited

U.S. PATENT DOCUMENTS

| | | | |
|---|---|---|---|
| 3,049,623 | 8/1962 | Du Vall | 323/270 |
| 3,535,613 | 10/1970 | Katezenstein | 323/8 |
| 4,555,660 | 11/1985 | von Winnicki | 323/224 |
| 4,806,844 | 2/1989 | Claydon et al. | 323/311 |
| 4,835,668 | 5/1989 | Palm et al. | 363/21 |
| 4,864,213 | 9/1989 | Kido | 323/222 |

FOREIGN PATENT DOCUMENTS 0164193 12/1985 European Pat. Off. ..... H02H 9/04

OTHER PUBLICATIONS

"Dissipation Limiter for Variable Power Supplies", Canterberry, Elektor Electronics, vol. 10, No. 7/8, 1984, pp. 755–756.

"Floating Regulator for a PMT Power Supply", Baumann, IBM Technical Disclosure Bulletin, vol. 9, No. 10, Mar., 1967, p. 1461.

*Primary Examiner*—Steven L. Stephan
*Assistant Examiner*—Ben Davidson
*Attorney, Agent, or Firm*—Ladas & Parry

[57] ABSTRACT

The invention relates to a regulated DC power supply circuit comprising a full wave rectification stage for rectifying an AC input and a regulating stage for regulating an output voltage from the rectification stage. The regulating stage has a primary voltage regulating circuit and a secondary voltage regulating circuit. The primary voltage regulating circuit includes a series pass element, such as a MOSFET device, connected to operate continuously in source-follower mode. A primary voltage reference element, such as a zener diode, provides a gate reference for the series pass element. The secondary voltage regulating circuit is cascaded to the primary voltage regulating circuit in a voltage sharing configuration. The power supply circuit is therefore capable of handling input voltages over 1 kV, which exceed the maximum voltage rating of the MOSFET device. The invention extends to a DC voltage regulator, which includes the regulating stage without the rectification stage.

3 Claims, 4 Drawing Sheets

REGULATED POWER SUPPLY CIRCUIT

BACKGROUND TO THE INVENTION

This invention relates to a regulated power supply circuit, as well as to a voltage regulator which is employed in such a circuit.

In the past, a number of problems have been associated with regulated power supply circuits which have to cope with wide input voltage ranges. At voltages in excess of 1 kV, only relatively low biasing currents can be fed to the power supply in order to avoid high power dissipation. The standard zener transistor configuration requires excessive zener biasing current which results in a high power dissipation. High voltage transistors exhibit relatively low current gains, and the basic current drawn by such transistors loads any reference and may drastically affect regulation with dynamic output loads.

At present, there exists no single commercially available transistor capable of efficiently providing a low voltage regulated supply from an unregulated input exceeding 1 kV.

SUMMARY OF THE INVENTION

According to the first aspect of the invention there is provided a regulated DC power supply circuit comprising a full wave rectification stage for rectifying an AC input and a regulating stage for regulating an output voltage from the rectification stage, the regulating stage having a primary voltage regulating circuit and a secondary voltage regulating circuit, the primary voltage regulating circuit including a series pass element connected to operate continuously in source-follower mode and a primary voltage reference element for providing a gate reference for the series pass element, and the secondary voltage regulating circuit being cascaded to the primary voltage regulating circuit in a voltage sharing configuration, whereby the power supply circuit is capable of handling input voltages which exceed the maximum voltage rating of the series pass element.

Preferably, the series pass element is FET device.

The secondary voltage regulating circuit preferably includes at least one series pass element connected to operate in source-or emitter-follower mode, and secondary voltage reference element for providing a gate or base reference.

The primary voltage reference element preferably includes at least one zener diode.

The primary voltage reference element conveniently has a voltage rating exceeding 100 V, and the FET device is preferably an N-type MOSFET device having a maximum voltage rating between 950 V and 1050 V.

The full wave rectification stage may be a three phase rectification stage, and the power supply circuit may be capable of receiving an input voltage ranging from 50 V phase voltage to 760 V line voltage.

The secondary voltage regulating circuit advantageously includes a supply output arranged to provide a constant output voltage under all load conditions, and a shunt trip DC output, both the supply output and the shunt trip output being fed from zener-regulated series pass elements connected in a source- or emitter-follower configuration.

The invention extends to a DC voltage regulator comprising a primary voltage regulating circuit and a secondary voltage regulating circuit, the primary voltage regulating circuit including a series pass element connected to operate continuously in source-follower mode and a primary voltage reference element for providing a gate reference for the series pass element, and the secondary voltage regulating circuit being cascaded to the primary voltage regulating circuit in a voltage sharing configuration, whereby the DC voltage regulator is capable of handling input voltages which exceed the maximum voltage rating of the series pass element.

The DC voltage regulator is preferably capable of receiving input voltages varying from 45 V DC to 1026 V DC, with a peak voltage of 1076 V.

DESCRIPTION OF EMBODIMENTS

Figure 1:
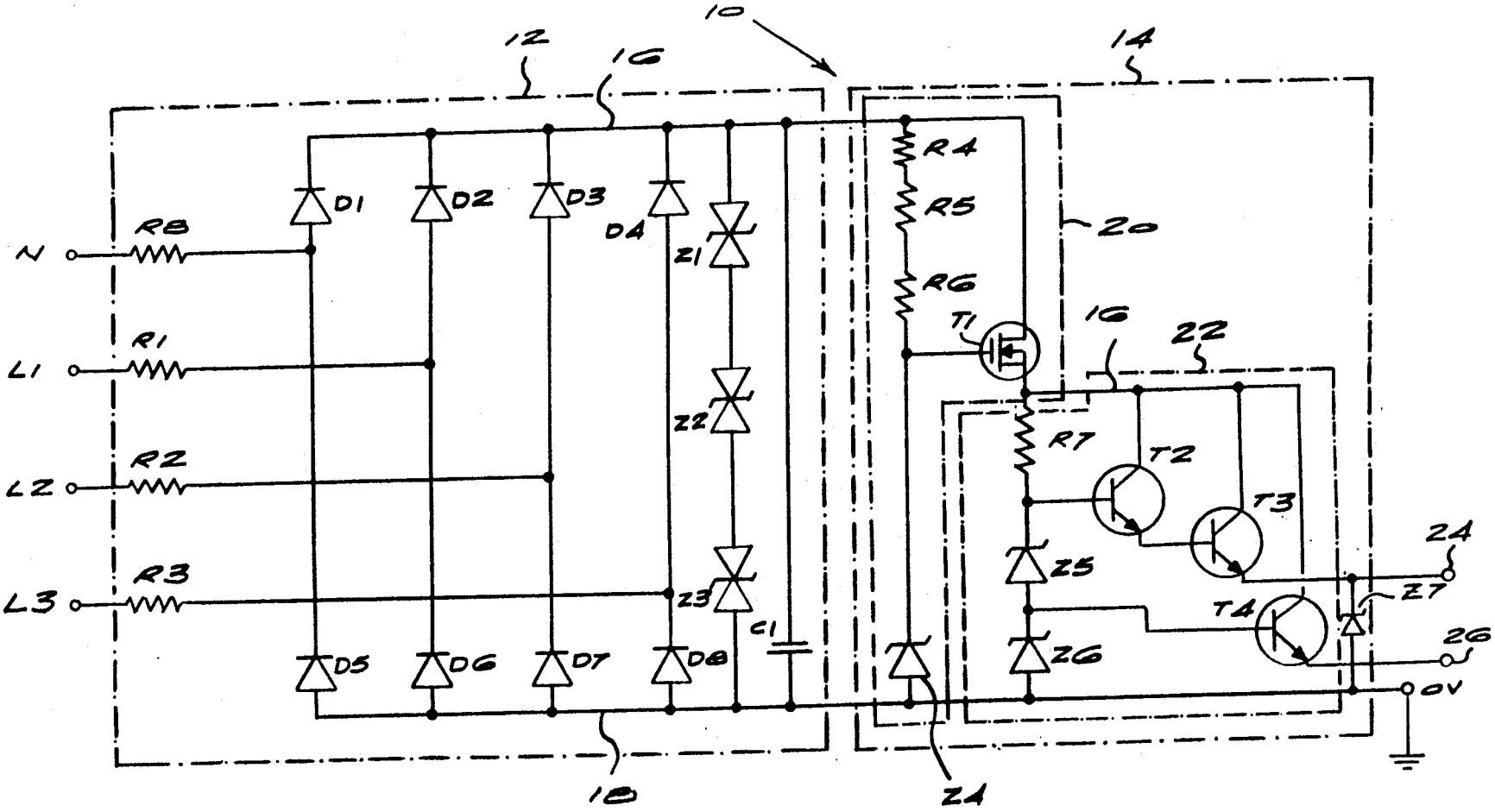
FIG. 1 shows a circuit diagram of a preferred first embodiment of a regulated power supply of the invention.

Referring to FIG. 1, a regulated power supply circuit 10 has a full wave rectifying stage 12 and a regulating stage 14. The rectifying stage 12 has a three-phase four wire input comprising a neutral line N and three live lines L1, L2 and L3. All the inputs L1, L2, L3 and N are provided with respective limiting resistors R1, R2 R3 and R8, which are in the form of 330 ohm wire wound resistors.

A standard full-wave rectifier, which requires no further explanation, is provided by diodes D1 to D8. Transorb surge protectors Z1, Z2 and Z3, which have a total rating of 1150 volts, are linked together in series and are shunted between the positive and negative rails 16 and 18 after the rectification diodes D1 to D8. The surge protectors are designed to handle a maximum expected line voltage of 760 volts between any two of the input lines. The DC output from the diodes is bypassed by means of a high frequency capacitor C1. The transorbs Z1, Z2 and Z3, together with the RC network provided by the resistors R1, R2, R3 and R8 and the capacitor C1, provide a high level of transient signal rejection. The transorbs provide protection against high voltage surges, and, by resistor current limiting, they are guarded against unlimited absorption of power, which is an important feature in noisy environments.

The rectifying stage 12 of the power supply is able to rectify any combination of at least two active inputs constituted by two or more of L1, L2, L3 and N. Under normal conditions, the input voltage can vary from 50 volts minimum phase voltage to 760 volts maximum line voltage.

The voltage regulating stage 14 is able to handle from a minimum of 45 volts DC up to a maximum of 1026 volts DC. This stage comprises a primary voltage regulating circuit 20 and a secondary voltage regulating circuit 22 cascaded to the primary voltage regulating circuit in a voltage dividing or sharing configuration. The primary regulating circuit comprises a 1 kV MOSFET transistor T1 biased in a zener-regulated source-follower configuration, and connected to operate continuously in source-follower mode. In this configuration, the MOSFET transistor T1 has a gate reference which comprises three 560K 0.6 watt current limiting resistors R4, R5 and R6 in series with a 110 volt zener Z4, which serve as primary voltage reference elements. At maximum input voltage in a three-phase system, total dissipation in the resistors R4, R5 and R6 is below 0.6 watts, which falls within the maximum power rating of each resistor. Three separate voltage sharing resistors R4, R5 and R6 are required to withstand voltage stress.

At relatively low input voltages, from approximately 50 volts rms to 110 volts rms, the zener diode Z4 is off and the limiting resistors R4, R5 and R6 hold the gate of the MOSFET T1 high at the input potential. The MOSFET transistor T1 is thus saturated on. As the input voltage rises up to 110 volts, the zener diode Z4 begins to turn on and to limit the gate potential, and consequently the output of the MOSFET T1 is held at a value just below 110 volts. Any further increase in the input voltage has no effect on the output of the MOSFET T1 as the zener Z4 is limited to 110 volts maximum under all conditions.

As the MOSFET T1 has a maximum voltage rating of 1 kV, it is necessary that, in order to cope with a peak voltage of 1074 volts, some of the maximum DC voltage input has to be shared in series with it. The MOSFET source output of 108 volts, which is controlled by the zener Z4, ensures that in worst case conditions, the MOSFET has to handle a peak voltage of no greater than 966 volts. As the gate of the MOSFET T1 hardly draws any current, the zener Z4 can safely be biased right at the edge of its "knee".

The output 16 of the primary regulating circuit 20 is fed to the input of the secondary voltage regulating circuit 22, which has the same basic configuration as the primary circuit. A Darlington transistor pair, which is constituted by transistors T2 and T3, is provided with a gate reference which is current limited by means of a 120K resistor R7. Regulation is achieved by means of a pair of reference zeners Z5 and Z6 having respective ratings of 15 V and 18 V. A 32 V shunt trip output 24 is provided at the emitter of the transistor T3.

A further transistor T4 is shunted biased from zener 26 and supplied from the output 16, with its emitter providing a regulated DC output 26 of 18 V under all load conditions, as is determined by zener diode Z6. A further zener diode Z7 is linked between the 32 V output from the emitter of transistor T3 and the negative rail 18. This zener serves to protect against induction spikes which may arise as a result of an inductive load on the 32 V DC shunt trip output 24.

Power dissipitation in the primary MOSFET T1 at maximum input voltage is approximately 1.25 watts. As the device is rated at 75 watts, large heat sink capacity is not necessary. However, under minimum air flow conditions, as in an earth leakage unit shell, a large surface area is required for the heat sink to compensate for the high thermal resistance of the enclosure.

Figure 2:
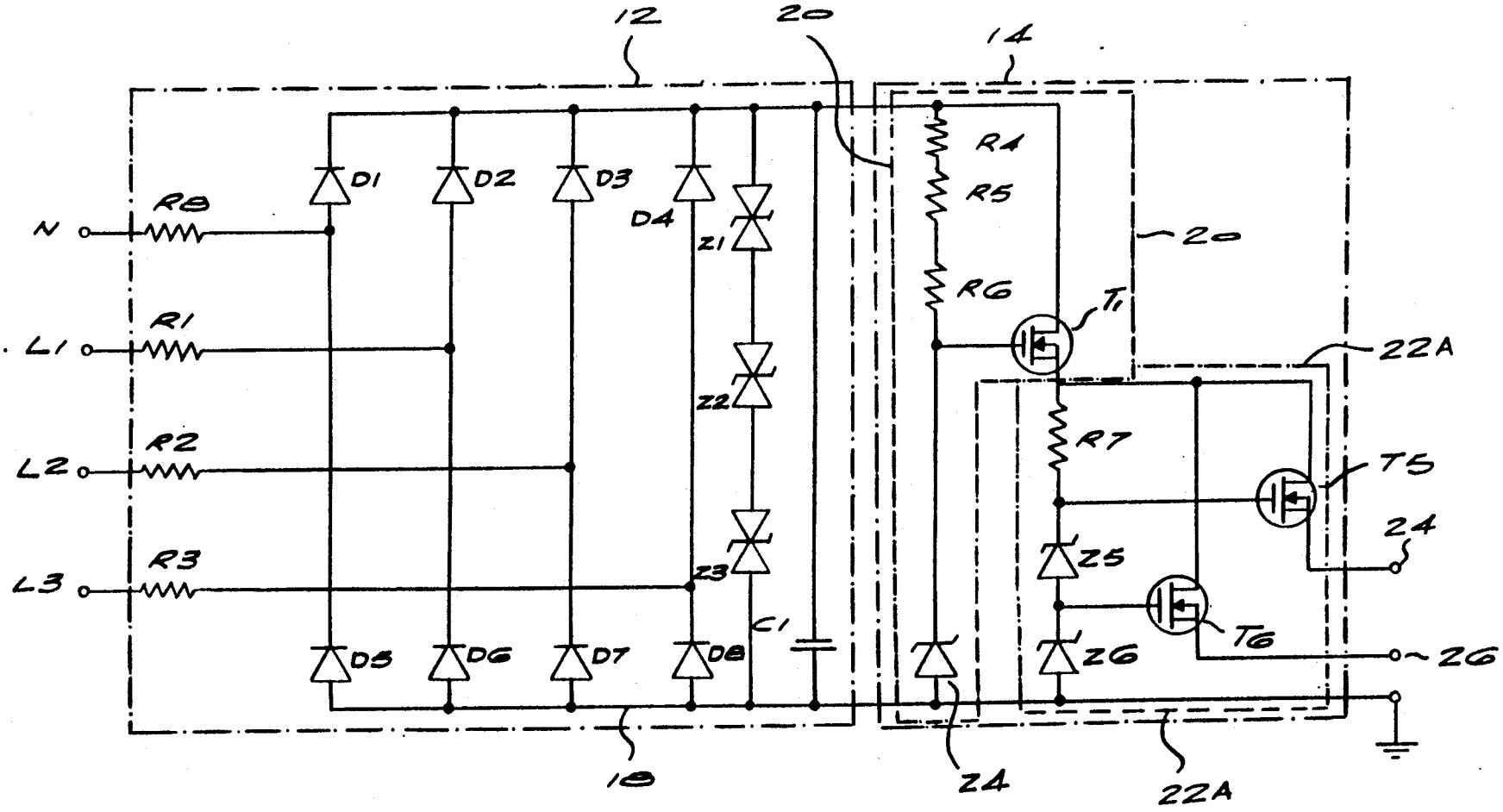
FIG. 2 shows a circuit diagram of a second embodiment of a regulated power supply.

Turning now to FIG. 2, a further embodiment of a regulated power supply is shown. The voltage rectification stage 12 and the primary regulating circuit 20 is identical to that illustrated in FIG. 1. In the secondary regulating circuit 22A, the principle difference is that regulation of the shunt trip and control outputs 24 and 26 are achieved with MOSFET transistors. A MOSFET transistor T5 replaces the Darlington couple T2 and T3, and a MOSFET transistor T6 replaces the bipolar transistor T4.

Figure 3:
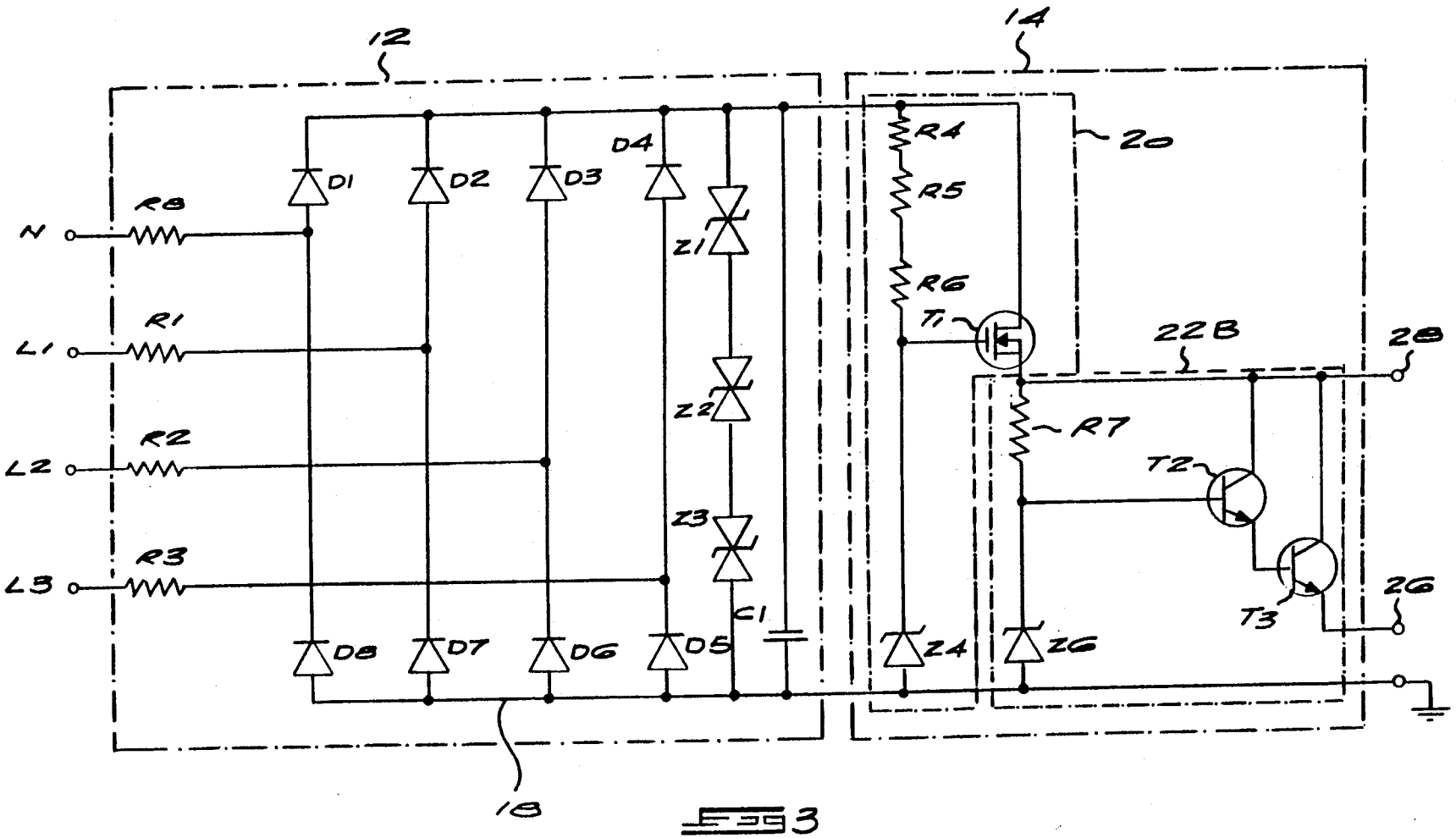
FIG. 3 shows a circuit diagram of a third embodiment of a regulated power supply.
Figure 4:
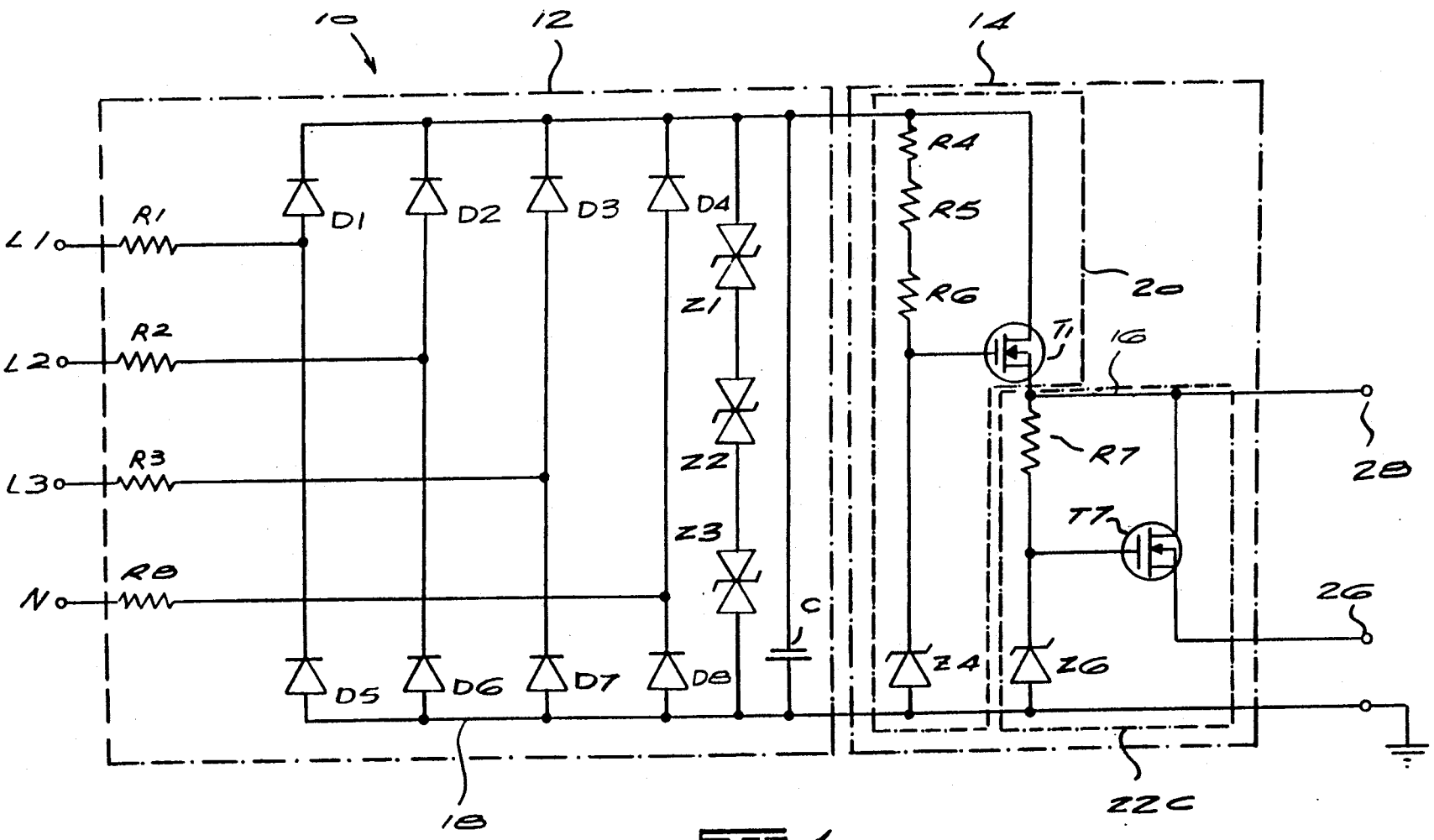
FIG. 4 shows a circuit diagram of a fourth embodiment of a regulated power supply.

Referring now to FIG. 3, yet further more basic embodiment of a regulated power supply is shown in which a secondary voltage regulating circuit 22B is in the form of a Darlington configuration similar to that in FIG. 1 comprising npn transistors T2 and T3. A regulated 18 V control output 26 is provided, together with an unregulated shunt trip output 28 fed directly from the primary regulating circuit. In FIG. 4, MOSFET transistor T7 replaces the Darlington configuration T2 and T3 in a secondary regulating circuit 22C.

The regulated linear power supply enjoys a number of advantages. It is able to handle an extremely wide input voltage range and has a relatively low power dissipation. The voltage regulation over the entire input range is extremely low. Furthermore, the circuit is relatively simple, having a low component count.

We claim:

1. A high voltage regulated DC power supply circuit comprising a full wave rectification stage for rectifying an input voltage of alternating current and a regulating stage capable of regulating an output voltage from the rectification stage in excess of 1 kV, the regulating stage having a primary voltage regulating circuit and a secondary voltage regulating circuit, the primary voltage regulating circuit having an open-loop configuration including a MOSFET-type device connected in a source-follower configuration, a primary voltage reference element for limiting a gate reference voltage to a gate of the MOSFET-type device to a maximum gate reference voltage, and a plurality of current limiting elements connected in series with the primary voltage reference element for limiting bias current to the gate and for sharing major portions of the output voltage from the rectification stage, and the primary voltage regulating circuit being directly cascaded to the secondary voltage regulating circuit in a voltage sharing configuration without a feedback or clamping circuit at an output from the MOSFET-type device, the MOSFET-type device arranged to operate in two modes, namely a first saturated on mode, in which the output voltage from the rectification stage is less than the maximum gate reference voltage, and the output from the MOSFET-type device follows the output voltage from the rectification stage, and a second on mode, in which the output voltage from the rectification stage exceeds the maximum gate reference voltage determined by the primary voltage reference element, and the output from the MOSFET-type device is held at approximately the maximum gate reference voltage provided by the primary voltage reference element, the power supply circuit being capable of handling an input voltage which exceeds a maximum-voltage rating of the MOSFET-type device.

2. A regulated DC power supply circuit as claimed in claim 1 in which the primary voltage reference element is a zener diode having a voltage rating exceeding 100 V, and the MOSFET-type device is an N-type MOSFET device having a maximum voltage rating between 950 V and 1050 V.

3. A regulated DC power supply circuit as claimed in claim 1 in which the full wave rectification stage is a three phase rectification stage, which incorporates limiting resistors and surge protectors, and the power supply circuit is capable of receiving input voltages ranging from 50 V phase voltage to 750 V line voltage.

* * * * *